US005659921A

United States Patent [19]

Narayan

[11] Patent Number: 5,659,921

[45] Date of Patent: Aug. 26, 1997

[54] SWEEPER WITH DOUBLE SIDE SKIRTS FOR DUST CONTROL

[75] Inventor: Nilabh Narayan, Plymouth, Minn.

[73] Assignee: Tennant Company, Minneapolis, Minn.

[21] Appl. No.: 589,613

[22] Filed: Jan. 22, 1996

[51] Int. Cl.[6] ..... E01H 1/08

[52] U.S. Cl. ..... 15/349; 15/340.3; 15/375

[58] Field of Search ..... 15/340.3, 340.4, 15/347, 348, 349

[56] References Cited

U.S. PATENT DOCUMENTS

| | | | |
|---|---|---|---|
| 1,546,441 | 7/1925 | Frayer | 15/348 |
| 1,845,740 | 2/1932 | Blaney . | |
| 3,221,358 | 12/1965 | Dickson | 15/340.3 X |
| 3,233,274 | 2/1966 | Kroll | 15/349 X |
| 3,892,008 | 7/1975 | Christensen et al. . | |
| 4,200,953 | 5/1980 | Overton | 15/349 |
| 4,320,556 | 3/1982 | Kimzey et al. . | |
| 4,355,435 | 10/1982 | Kimzey et al. . | |
| 4,951,347 | 8/1990 | Star et al. | 15/340.3 |
| 5,249,332 | 10/1993 | Wilkerson . | |
| 5,394,586 | 3/1995 | Holley . | |

FOREIGN PATENT DOCUMENTS

| | | | |
|---|---|---|---|
| 757297 | 4/1967 | Canada | 15/340.4 |

*Primary Examiner*—Chris K. Moore

*Attorney, Agent, or Firm*—Dorn, McEachran, Jambor & Keating

[57] ABSTRACT

A sweeping machine has a body, wheels supporting the body for movement over a surface to be swept and a rotatable brush mounted to the body transversely of the direction of movement of the sweeping machine. There is a debris hopper adjacent the rotatable brush and positioned generally forwardly of the direction of rotation of the brush. The body mounts a dust collection chamber and a vacuum fan, with the vacuum fan drawing dust laden air from the area about the brush through the debris hopper and into the dust collection chamber. The improvement is directed to a dust control side skirt assembly mounted on each side of the body generally in alignment with the brush. Each assembly includes an inner skirt and an outer skirt spaced outwardly from the inner skirt throughout at least a substantial portion of its length. There is an ambient air opening between the skirts generally at the rear end thereof. There is an opening in the inner skirt adjacent a forward portion thereof whereby the vacuum fan creates an air flow path from the ambient air opening, between the skirts, and through the inner skirt opening and into the debris hopper and dust collection chamber.

8 Claims, 2 Drawing Sheets

SWEEPER WITH DOUBLE SIDE SKIRTS FOR DUST CONTROL

THE FIELD OF THE INVENTION

The present invention relates to sweeping machines of the type used to sweep streets, parking lots, other roadway areas, as well as the floors of industrial and commercial buildings. A problem with sweepers of this type is dust control, particularly dust control in the areas of the sweeper side skirts. The brush of the sweeper pumps dust laden air to the side, and angled toward the front of the machine at normal to slow travel speeds, this being termed a positive outward air flow. A common method of eliminating dust emission from sweepers is to create sufficient inward or negative air flow around the brush chamber at the skirts-ground interface, through the hopper and dust filter by the use of a vacuum fan. The primary paths of dust control air flows around the brush chambers are hopper lip areas, wheel well skirt bottoms, rear skirts, and side skirts with the highest need for air flow occurring in the immediate vicinity of the bristle to ground contact region underneath the side skirts.

As the vacuum system is turned on, air flow distributes itself amongst the various paths, generally inversely proportional to flow resistance, with the largest air flow being along the path of least resistance and the smallest air flow being from the path of greatest resistance, which on sweepers is the side skirt area in the immediate proximity of the bristles. This is also the area of primary dust generation. To keep sweepers from dusting, the dust control air flow velocity must be sufficiently high to impart a resultant velocity vector towards the brush chamber. Thus, the vacuum fan must create sufficiently high negative air flow near the bristle area and under the side skirts, while it also creates a much higher collateral air flow from the lower flow resistance paths of the machine. The dusting air flow created by the brush increases between the square and cube of bristle tip speed in typical brush configurations. Thus, the dust control problem becomes even more severe in machines which involve brushes having smaller diameter bristles and higher brush speeds.

The present invention solves the above-described dusting problem by creating a lower flow resistance path for dust control air flow in the area of the side skirts to give greater dust control air flow in this region for the same vacuum fan capacity. The air flow path is defined between two parallel side skirts, one heavy, relatively low flexibility inner side skirt extending from the rear skirt to the front of the brush compartment and having a lower edge at or along the surface being swept. This inner side skirt functions primarily to contain debris and dust from being blown from the ends of the cylindrical brush. There is a second exterior rubber side skirt which runs essentially parallel to the interior side skirt and serves to channel the dust control air flow along a path between the side skirts and into an opening near the top front end of the inner side skirt that allows the dust control air flow to pass from between the two side skirts and into the hopper and then into the dust collection chamber. The two side skirts are joined at their forward end and have an opening at their rear end. The rear end opening provides a path for the entrance of air and there is another path for the entrance of air underneath the outer side skirt which is slightly spaced above the surface being swept.

In a further embodiment, the air flow velocity between the side skirts may be increased by the use of a curved element along the top between the side skirts, which curved upper element creates a venturi effect near the brush contact region.

SUMMARY OF THE INVENTION

The present invention relates to power driven sweeping machines and particularly to an improved dust control system for such a machine.

A primary purpose of the invention is to provide a system of eliminating dusting or dust emission from the areas adjacent the ends of a transversely oriented sweeping brush.

Another purpose of the invention is to provide a side skirt assembly which creates a lower flow resistance path for dust control air flow in the area adjacent the ends of the sweeping brush.

Another purpose is a side skirt assembly as described consisting of an inner skirt and an outer skirt with an air flow path between the skirts.

Another purpose is a side skirt assembly as described using a venturi effect to increase air flow velocity in the areas adjacent the ends of the sweeping brush.

Another purpose of the invention is to provide a simply constructed reliably operable double side skirt arrangement for a sweeping brush which provides substantial improvements in dust air flow control.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention provides a side skirt assembly, one for each side of the sweeper, which side skirt assembly provides a lower flow resistance path for dust control air flow, with the result of greater dust control air flow in the region of the side skirts, without an increase in vacuum fan capacity. The air flow path consists of one heavy rubber inner side skirt extending from the rear skirt to the front of the brush compartment and having a lower edge which is at or along the surface being swept. The inner side skirt functions primary to contain debris and dust from being blown from the ends of the cylindrical brush. There is a second exterior rubber side skirt which runs essentially parallel to the inner side skirt, is substantially more flexible than the inner side skirt, and is spaced from the surface being swept. Air can flow beneath the outer side skirt and into the air flow space between the skirts. There is a rear entrance into the air flow path between the skirts and there is an exit which is at an upper forward portion of the inner skirt.

The conventional pea gravel skirt may be rearwardly extended several inches beyond the brush axis to increase the efficiency of the side skirt assembly. Further, the upper surface of the air flow path between the side skirts may be curved to provide a venturi effect which increases air flow velocity.

The above-described side skirt assembly solves the problem of moving dust laden air from the ends of the brush, which are the areas of highest resistance to air flow in prior art sweepers of the type described.

Figure 1:
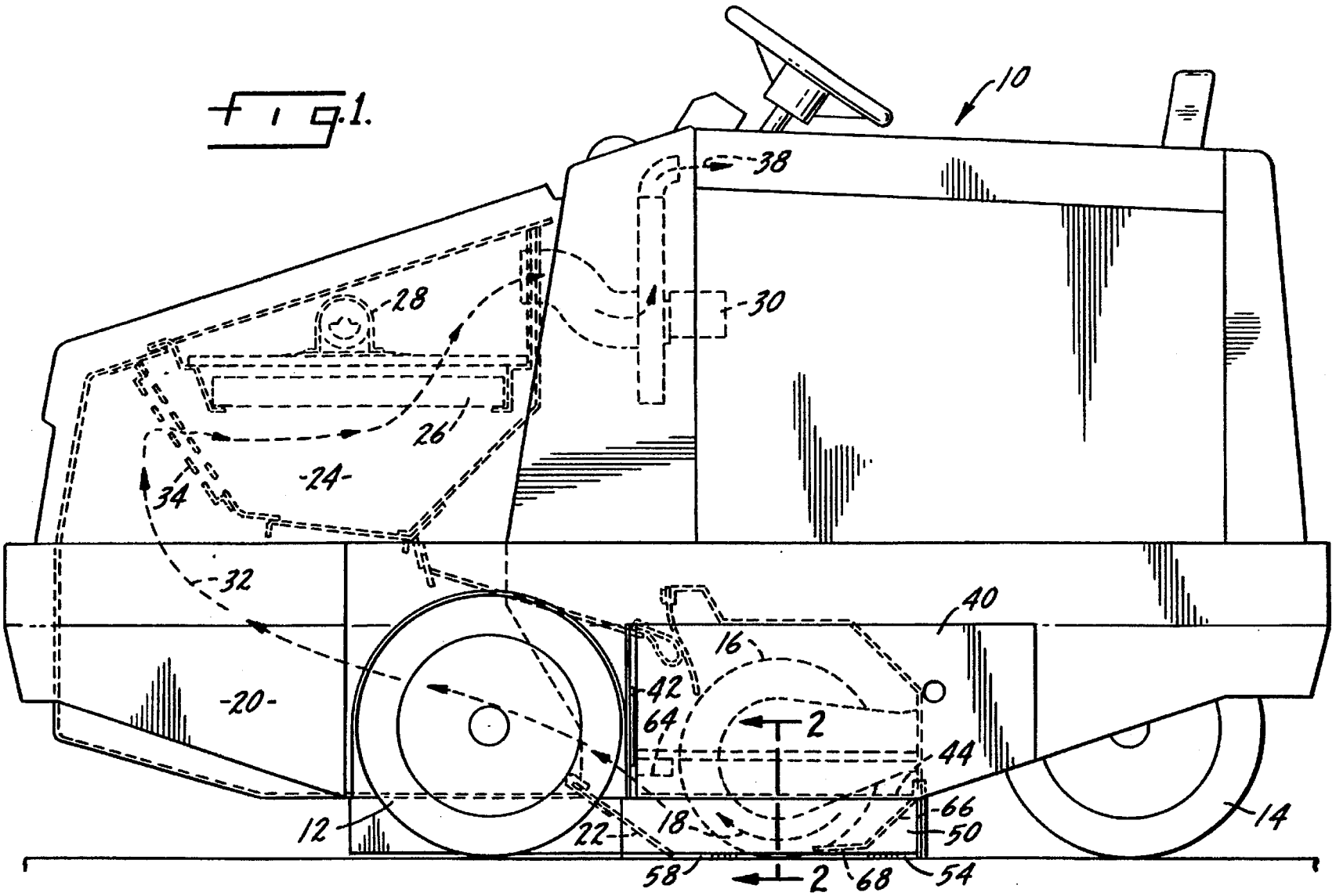
FIG. 1 is a diagrammatic illustration of a sweeping machine, with many of the internal parts being shown in phantom.

In FIG. 1 the sweeping machine is indicated to have a body indicated generally at 10 and driving wheels 12 and 14. As is conventional in machines of this type there may be two forward driving wheels and a single rear wheel, although the invention should not be so limited. There is a rotatable brush 16 which extends transversely across the body of the machine and as illustrated by the arrow 18 will be rotated in a clockwise direction to direct dust and debris forwardly into a debris collection chamber or hopper indicated generally at 20. There is a ramp 22 which defines the entrance to the debris chamber 20, with the debris chamber being forward of the brush as is customary in forward throw sweeping machines. Positioned above and slightly forward of the debris chamber 20 is a dust collection chamber 24 having a filter assembly 26 therein, with the filter assembly having a movable shaker 28 mounted thereon. Further details of the sweeper may be shown in U.S. Pat. No. 5,303,448, assigned to the assignee of the present application, Tennant Company, of Minneapolis, Minn. The disclosure of the '448 patent is expressly incorporated by reference herein.

Above and to the rear of the dust collection chamber 24 is a vacuum fan indicated diagrammatically at 30, with the vacuum fan creating an air flow path indicated by the series of arrows designated at 32. The air flow path begins directly adjacent the forward throwing sweeping brush 16, passes through the debris chamber 20, then through a series of baffles 34 into the dust collection chamber 24. The air flow path then passes through the filter 26 and exhausts from the vacuum fan as indicated by the arrow 38. The described dust collection path is conventional in sweeping machines of this type.

Figure 2:
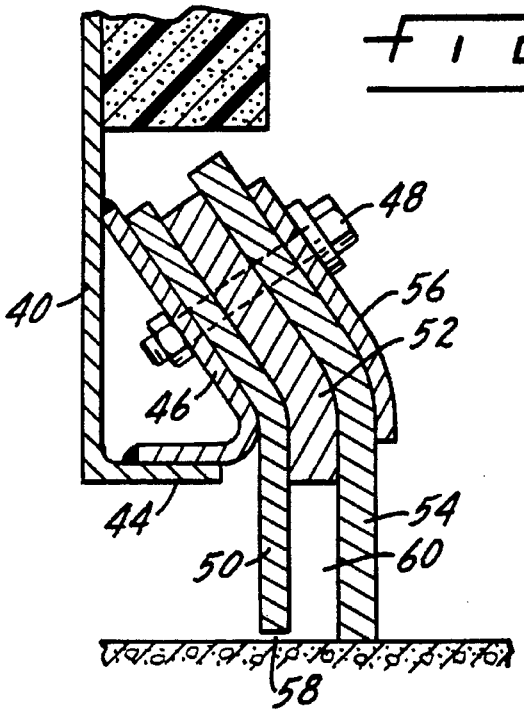
FIG. 2 is a section along plane 2—2 of FIG. 1.
Figure 3:
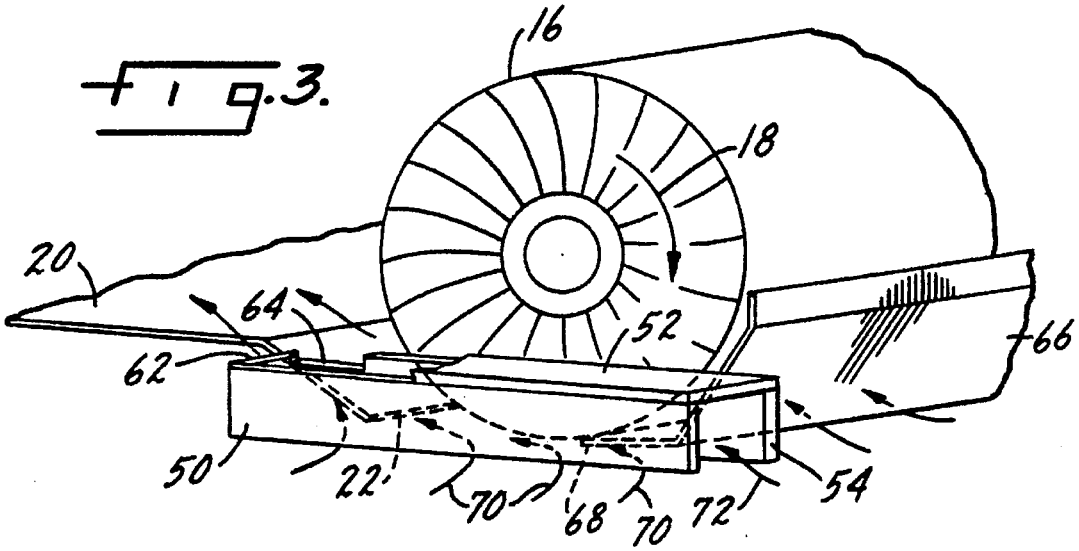
FIG. 3 is a diagrammatic illustration of the air flow path provided by the side skirt assembly of the present invention.

As indicated above, the problem of dusting, or the pumping of dust laden air to the side of the brush 16, is overcome by the use of a double side skirt assembly which will be attached to the door 40 which is hinged along its front edge 42 and which covers the sweeping brush and provides access thereto for maintenance and cleaning. The door 40 will carry the double side skirt dust control assembly of the present invention with such being illustrated in detail in FIGS. 2 and 3. The door 40 has a lower inwardly extending flange 44 which carries a support bracket 46. A bolt or other suitable type of fastener indicated at 48 attaches together the support bracket 46, the flexible outer skirt 50, a spacer 52, the somewhat stiffer inner skirt 54, and a further curved support bracket 56. There will be a side skirt assembly such as illustrated in FIGS. 2 and 3 on both sides of the sweeping machine and preferably these side skirt assemblies will be mounted on the door 40 as the door 40 is directly adjacent the ends of the brush, the area requiring the greatest need for dust control. Directly behind the brush 16 is a recirculation flap 66 having a forward flap 68.

The outer skirt 50, which will be somewhat more flexible than the inner skirt 54, is slightly spaced, as indicated at 58, from the surface to be swept, providing an air gap for the entrance of ambient air under the outer skirt into the chamber 60 formed between the two skirts. The inner and outer skirts 50 and 54 are joined together, as at 62, adjacent their forward ends and there is an opening 64 in the upper forward end of the inner skirt 54.

FIG. 3 diagrammatically illustrates the path of air flow which is created by the double side skirt assembly. Air may enter the passage or chamber 60 between the inner and outer skirts through the area beneath the outer skirt 50 as indicated by arrows 70. Air may also enter the open rear end of chamber 60 and follow the path shown by arrow 70 into the chamber. thus, air is entering into the chamber 60 from both beneath the outer skirt and through the rear space between the skirts, with such air picking up any dust laden air which may escape from underneath the inner skirt in the area directly adjacent the end of the brush, the area requiring greatest dust control. The dust laden air which will pass through the chamber 60 and will then exit out of the opening 64 into the debris hopper 20 and will be moved along in the path of general air flow as described in connection with FIG. 1.

Figure 4:
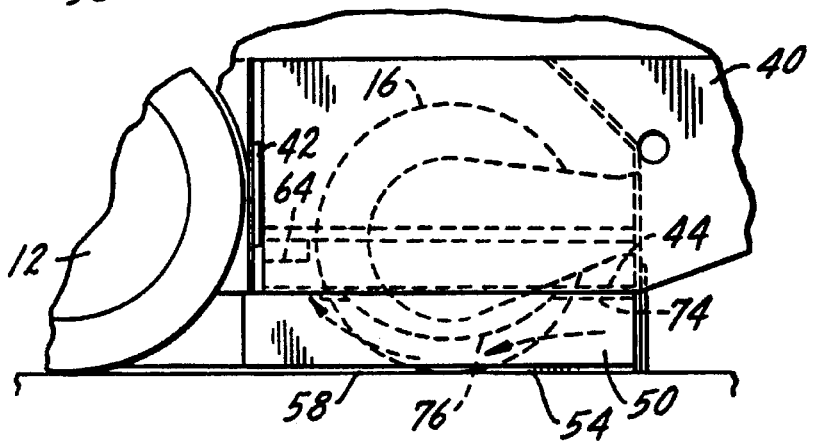
FIG. 4 is a partial side view showing a modified form of the invention.

In the modification of FIG. 4 there may be a cover 74 for the chamber 60 which will have a lower curved surface 76 which will provide a venturi effect directly adjacent brush 16 to increase air velocity in the area of greatest dusting. In other respects, the embodiment of FIG. 4 is the same as shown in FIGS. 1, 2 and 3.

The side skirt assembly provides the unique advantage of preventing dusting or the escape of air from the area adjacent the ends of the brush and moves this dust laden air into the debris hopper dust collection chamber and filter. A principal advantage in the double side skirt assembly, in addition to preventing dusting as described, is that it does so without any increase in vacuum fan capacity. In prior art machines in order to overcome the dusting problem it was necessary to materially increase vacuum fan capacity. The side skirt assembly, by providing a unique path of air flow in the area requiring greatest dust control does so without any increase in the size of the vacuum fan.

Whereas the preferred form of the invention has been shown and described herein, it should be realized that there may be many modifications, substitutions and alterations thereto.

The embodiments of the invention in which an exclusive property or privilege is claimed are defined as follows:

1. A sweeping machine having a body, wheels for supporting the body for movement over a surface to be swept, a rotatable brush mounted to the body transversely of the direction of movement of the sweeping machine, a debris hopper adjacent said rotatable brush, a dust collection chamber in said body, a vacuum fan mounted on said body to draw dust laden air from the area about the brush, through said debris hopper and into said dust collection chamber, the improvement comprising a dust control side skirt assembly mounted on each side of said body generally in alignment with said brush, each assembly including an inner skirt and an outer skirt outwardly spaced throughout at least a substantial portion of its length from said inner skirt, an ambient air opening between said skirts and located in a rearward direction from said brush and debris hopper, and an opening in said inner skirt adjacent a forward portion thereof whereby said vacuum fan creates an air flow path through said ambient air opening, between said skirts, through said inner skirt opening and into said debris hopper and dust collection chamber.

2. The sweeping machine of claim 1 wherein each outer skirt is positioned slightly above the surface to be swept whereby ambient air is drawn in from underneath said outer skirt into the air flow path between said skirts.

3. The sweeping machine of claim 2 wherein each inner skirt is positioned to be generally at a position of contact with the surface to be swept.

4. The sweeping machine of claim 3 wherein each inner skirt opening is at the forward end of said skirt assembly and generally at an upper portion of the inner skirt.

5. The sweeping machine of claim 3 wherein each inner skirt is joined to its adjacent outer skirt at the forward ends thereof.

6. The sweeping machine of claim 5 wherein said inner and outer skirts are joined along the upper edges thereof to create air flow chambers from the rear ambient opening to the opening at the upper edge of the inner skirt.

7. The sweeping machine of claim 6 wherein the upper edge of said air flow chambers is curved adjacent the side brush.

8. The sweeping machine of claim 1 wherein said inner skirt in each assembly is stiffer than the outer skirt.

* * * * *